US011202135B2

(12) United States Patent
Vavron

(10) Patent No.: US 11,202,135 B2
(45) Date of Patent: Dec. 14, 2021

(54) SPEAKER ASSEMBLY WITH FRONT PANEL

(71) Applicant: LPG LAUTSPRECHER-PRODUKTIONS-GESELLSCHAFT MBH, Neu-Ulm (DE)

(72) Inventor: Philipp Vavron, Illertissen (DE)

(73) Assignee: LPG LAUTSPRECHER-PRODUKTIONS-GESELLSCHAFT MBH, Neu-Ulm (DE)

( * ) Notice: Subject to any disclaimer, the term of this patent is extended or adjusted under 35 U.S.C. 154(b) by 0 days.

(21) Appl. No.: 16/979,228

(22) PCT Filed: Nov. 28, 2018

(86) PCT No.: PCT/EP2018/000536
§ 371 (c)(1),
(2) Date: Sep. 9, 2020

(87) PCT Pub. No.: WO2019/174703
PCT Pub. Date: Sep. 19, 2019

(65) Prior Publication Data

US 2020/0413173 A1 Dec. 31, 2020

(30) Foreign Application Priority Data

Mar. 16, 2018 (DE) ..... 202018001410.9

(51) Int. Cl.
*H04R 1/02* (2006.01)
*H04R 7/12* (2006.01)
*H04R 9/06* (2006.01)

(52) U.S. Cl.
CPC ..... *H04R 1/023* (2013.01); *H04R 7/127* (2013.01); *H04R 9/06* (2013.01); *H04R 2201/021* (2013.01); *H04R 2499/13* (2013.01)

(58) Field of Classification Search
CPC ..... H04R 1/023; H04R 7/127; H04R 9/06; H04R 2201/021; H04R 2499/13
See application file for complete search history.

(56) References Cited

U.S. PATENT DOCUMENTS 3,679,023 A * 7/1972 Rankin ..... H04R 1/023 181/155
3,989,909 A 11/1976 Hodsdon
3,995,125 A 11/1976 Cypser
(Continued)

FOREIGN PATENT DOCUMENTS

DE 849253 B 9/1952
DE 202009015015 U 4/2010
FR 2748627 A 11/1997
(Continued)

*Primary Examiner* — Sunita Joshi
(74) *Attorney, Agent, or Firm* — Andrew Wilford

(57) ABSTRACT

The invention relates to a loudspeaker unit (10), which includes a housing (12) that has a peripheral housing edge (14) and a front element (20), and a loudspeaker, which is arranged inside the housing (12), wherein the loudspeaker has an in particular dome-shaped diaphragm, which is arranged behind the front element (20). In order to improve the loudspeaker unit (10) having the loudspeaker and the housing (12), according to the invention, the front element (20) has a multiplicity of passage openings (26), and the individual passage openings (26) are formed in the manner of a labyrinth.

7 Claims, 1 Drawing Sheet

(56) References Cited

U.S. PATENT DOCUMENTS

| | | | | | |
|---|---|---|---|---|---|
| 4,196,791 | A * | 4/1980 | Gottlieb | ..... | H04R 1/023 181/149 |
| 2012/0321121 | A1 * | 12/2012 | Taylor | ..... | H04R 1/023 381/391 |

FOREIGN PATENT DOCUMENTS

| | | | | | |
|---|---|---|---|---|---|
| FR | 2748627 | A1 * | 11/1997 | ..... | H04R 1/023 |
| JP | 09327082 | B | 12/1997 | | |
| JP | 2016092671 | B | 5/2016 | | |

* cited by examiner

SPEAKER ASSEMBLY WITH FRONT PANEL

CROSS REFERENCE TO RELATED APPLICATIONS

This application is the US-national stage of PCT application PCT/EP2018/000536 filed 28 Nov. 2018 and claiming the priority of German patent application 202018001410.9 itself filed 16 Mar. 2018.

TECHNICAL FIELD

The invention relates to a speaker assembly having a dynamic voice coil loudspeaker. Assemblies of this type are common and can be used in the automotive sector for example, as they can comparatively easily be adapted to the acoustic and spatial requirements due to their relatively simple structure.

PRIOR ART

Dynamic moving-coil loudspeakers are known. Generic loudspeakers have a magnet pot, in which a permanent magnet is arranged. An annular gap is located between the permanent magnet and the magnet pot. A voice coil, on which a diaphragm is fastened, dips into this annular gap. The diaphragm is cupped over at least the permanent magnet and is fastened on the magnet cup by a bead. According to DE 20 2009 015 115 U1, a lighting device may be present in the region of the bead. The bead may actively illuminate or also be passively illuminated by this lighting device, so that optically attractive effects are possible.

The loudspeakers themselves are regularly in an enclosure. Due to the enclosure, the loudspeakers can quickly and reliably be installed in different environments.

At the same time, the enclosure offers protection from damage due to impacts.

DESCRIPTION OF THE INVENTION

Starting from this previously known prior art, the object of the invention is to provide an improved speaker assembly having a dynamic moving-coil loudspeaker of the type described above and an enclosure.

The speaker assembly according to the invention is specified by the features of the main claim 1. Sensible developments of the invention are the subject matter of further claims following the main claim.

The speaker assembly according to the invention has an enclosure having a peripheral rim and a front panel. A loudspeaker is inside the enclosure. The normally cup-shaped diaphragm of the loudspeaker is behind the front panel in this case. According to the invention, the front panel has a multiplicity of passage openings each constructed in the manner of a labyrinth.

Due to the labyrinthine construction of the passage openings, there is no direct connection between the diaphragm of the loudspeaker and the exterior. As a result, although the sound waves can only get outside by detours—by reflections—foreign objects can also only get behind the front panel from the outside with difficulty. Foreign objects of this type—for example dust, stone, gravel or else water and other liquids—may impact against the diaphragm unimpeded without such a front panel. Depending on the speed of the impacting foreign objects, the loudspeaker diaphragm may be damaged or even destroyed during the striking of the foreign objects. By contrast, if the foreign objects must initially pass the labyrinthine passage openings, in the best case, the penetration of the foreign objects may be prevented completely. In this case, the speed may be reduced to such an extent due to the repeated deflection of the foreign objects during passage of the passage openings, that the energy thereof is so low upon impact against the diaphragm, that no further significant damage can be caused at the diaphragm. The speaker assembly according to the invention may therefore in particular also be reliably and permanently used outdoors.

In a particularly constructively simple embodiment, the front panel may have a plurality of parallel running, mutually spaced bars. In this case, the passage openings would be constructed in a slit-shaped manner. The bars each may have a respective profiled side surface in order to equip the passage openings with the labyrinthine structure. The bars may each preferably have profiled side surfaces on both sides, in order to shape the labyrinthine structure of the passage openings in a particularly pronounced manner.

In a particularly preferred embodiment, two adjacent bars may have a zipper-like structure on their respective mutually facing side surfaces. The labyrinthine structure of the front panel may therefore be particularly pronounced, which entails a particularly effective protection of the loudspeaker diaphragm. Further advantages and features of the invention are to be drawn from the features additionally specified in the claims and the following embodiments.

LIST OF FIGURES

The invention is described and explained in more detail in the following on the basis of the embodiment illustrated in the drawing. In the figures.

WAYS OF REALIZING THE INVENTION

Figure 1:
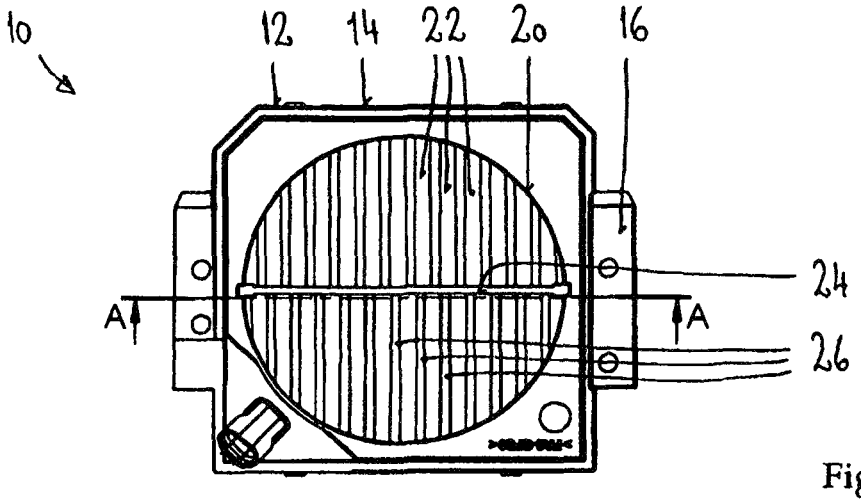
FIG. 1 is a plan view onto the speaker assembly according to the invention.
Figure 2:
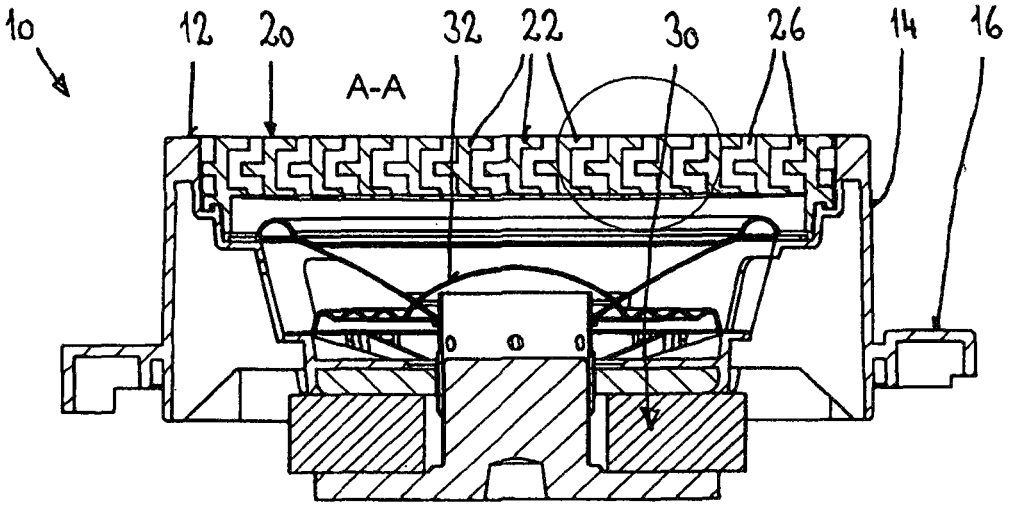
FIG. 2 is a cross section along the line A-A of the speaker assembly according to FIG. 1.
Figure 3:
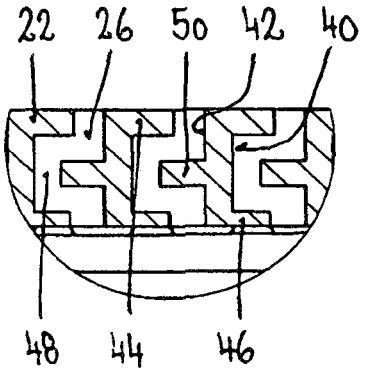
FIG. 3 shows a detail view of the bars of the front panel of the speaker assembly according to FIG. 2.

The speaker assembly 10 according to the invention is illustrated schematically in FIGS. 1 to 3. The speaker assembly 10 has an enclosure 12 with a peripheral rim 14. The enclosure edge 14 has a fastening flange 16 in sections. The enclosure edge 14 may be fastened on a suitable component by this fastening flange 16, in order to mount the speaker assembly 10 at a predetermined location. The enclosure 12 has a circular front panel 20 on the front side.

The front panel 20 has a multiplicity of bars 22 in the present embodiment. The bars 22 each run from the edge of the front panel 20 to a central slat 24. The central slat 24 runs through the central point of the front panel 20 and is used for fastening the individual bars 22. The bars 22 run parallel to one another and have a predetermined mutual spacing. In this manner, the bars 22 form slit-shaped passage openings 26.

A loudspeaker 30 is located in the interior of the enclosure 10. In the present embodiment, the loudspeaker 30 is a dynamic moving-coil loudspeaker, as known from the prior art. In principle, other types of loudspeakers 30 may also be used in the speaker assembly 10 according to the invention. The loudspeaker 30 has a cup-shaped upwardly concave diaphragm 32. This diaphragm 32 is below the front panel 20. In order to protect the diaphragm 32 from damage, the passage openings 26 are each constructed in the front panel

20 in the manner of a labyrinth (cf. FIGS. 2 and 3). In the present embodiment, the individual bars 22 have identical cross sections. The bars 22 each have a right side surface 40 and a left side surface 42. In the present embodiment, the right side surface 40 has a projecting web 44, 46 at its upper and lower edges. Each such pair of projecting webs 44, 46 forms a central groove 48 in the right side surface 40 as a result. The left side surface 42 has a single projecting web 50 at the center. The central web 50 of the left side surface of each bar 22 projects somewhat into a respective groove 48 of the right side surface 40 of an adjacent bar 22. A zipper-like structure is formed as a result. A labyrinthine construction of the passage openings 26 results due to this zipper-like structure.

The labyrinthine structure depicted here on the one hand allows the sound waves created to be optimally reflected and not be swallowed by the front panel 20, so that a good sound result is possible, as before. On the other hand, the diaphragm 32 of the loudspeaker 30 is adequately protected from penetrating foreign objects. Foreign objects coming from outside must first get through the labyrinthine structure before they can impact the diaphragm 32. When passing the labyrinthine structure, the speed of the foreign objects is braked to such an extent, however, that they can no longer do damage when impacting against the diaphragm 32. A large part of the foreign objects therefore may be completely prevented from penetrating into the interior of the enclosure 12 by the labyrinthine structure.

In contrast to the embodiment illustrated here, other labyrinthine structures of the passage openings 26 could also be realized. Alternatively or additionally thereto, the front panel 20 may be constructed in a lattice-shaped manner, so that punctiform passage openings 26 would be formed.

The invention claimed is:

1. A speaker assembly comprising:

an enclosure having a peripheral rim and a front panel, and a loudspeaker inside the enclosure and having an in particular cup-shaped diaphragm behind the front panel, the front panel being formed in front of the speaker with a plurality of longitudinally extending, parallel, and transversely spaced bars having side faces forming a multiplicity of longitudinally extending passage openings of labyrinthine section, whereby a foreign object from outside must pass front-to-back through one of the passages with two direction changes to enter the enclosure.

2. The speaker assembly according to claim 1, wherein the side faces are profiled side surface.

3. The speaker assembly according to claim 2, wherein the bars each have their profiled side sur faces on both sides.

4. The speaker assembly according to claim 3, wherein two adjacent bars each have a zipper-like structure on their mutually facing side sur faces.

5. The speaker assembly according to claim 2, wherein all bars of the front panel are of identical cross section.

6. The speaker assembly according to claim 1, wherein the loudspeaker is a dynamic moving-coil loudspeaker.

7. The speaker assembly according to claim 1, wherein each passage is formed between a pair of the side faces of respective flanking bars, one of the side faces of each pair being formed with two transversely projecting vanes spaced apart front-to-back and the other side face of each pair projecting transversely and spacedly between the two respective vanes of the respective pair.

* * * * *